US007117763B2

(12) United States Patent
Powell et al.

(10) Patent No.: US 7,117,763 B2
(45) Date of Patent: Oct. 10, 2006

(54) TOOL FOR INSTALLING THREADED KNIVES WITH LOCK NUTS

(75) Inventors: Duane William Powell, La Porte City, IA (US); James Anton Miller, Cedar Falls, IA (US); Thomas Edward VanVeldhuizen, Cedar Falls, IA (US)

(73) Assignee: American Soil Technologies, Inc., Pacoima, CA (US)

( * ) Notice: Subject to any disclaimer, the term of this patent is extended or adjusted under 35 U.S.C. 154(b) by 0 days.

(21) Appl. No.: 11/298,097

(22) Filed: Dec. 9, 2005

(65) Prior Publication Data

US 2006/0123953 A1 Jun. 15, 2006

Related U.S. Application Data

(60) Provisional application No. 60/635,046, filed on Dec. 9, 2004.

(51) Int. Cl.
*B25B 21/00* (2006.01)

(52) U.S. Cl. ..... 81/55; 81/125; 81/121.1; 81/451

(58) Field of Classification Search ..... 81/55, 81/121.1, 125, 541, 56, 57.16, 57.34
See application file for complete search history.

(56) References Cited

U.S. PATENT DOCUMENTS 4,836,063 A * 6/1989 Fushiya ..... 81/55
5,438,891 A * 8/1995 Batten ..... 81/56
5,964,128 A * 10/1999 Kaneyama et al. ..... 81/56

* cited by examiner

*Primary Examiner*—Lee D. Wilson
*Assistant Examiner*—Anthony Ojini
(74) *Attorney, Agent, or Firm*—Venable, Campillo, Logan & Meaney, P.C.

(57) ABSTRACT

A tool for installing threaded parts with lock nuts onto a machine is disclosed. The tool includes an outer tube and an inner mechanism that rotate together or independently using cogs. When the outer tube and inner mechanism rotate together, the threaded part is tightened onto a machine. When the outer tube and inner mechanism rotated independently, the lock nut is tightened onto the threaded part.

7 Claims, 11 Drawing Sheets

TOOL FOR INSTALLING THREADED KNIVES WITH LOCK NUTS

CROSS-REFERENCE TO RELATED APPLICATION

The present application claims priority to copending US provisional application entitled "Tool For Installing Threaded Knives With Lock Nuts," having Ser. No. 60/635,046, filed by inventor James Miller on Dec. 9, 2004, which is entirely incorporated herein by reference.

FIELD OF THE INVENTION

The present invention relates generally to an installation tool and, more particularly, to a tool that allows a user to install a specific threaded part in an assembly.

BACKGROUND OF THE INVENTION

The ability to insert specific parts onto a machine where there is not much room or where it may be dangerous for a person to reach is important. Specifically, when inserting a sharp part on a machine in a hard to reach place, the user needs to be protected from injury. One way to do this is to use a tool that gives the user the ability to extend his or her reach while installing the specific part. However, the tool may not orient the part properly on the machine or securely tighten a lock nut on the part.

For example, the fluid injection machine described in U.S. Pat. No. 6,848,376 includes many sharp injection knives on its fluid distribution disc. The injection knives penetrate the ground and inject specialized fluids, such as fertilizer, into the soil. These injection knives are arranged close together and in a specific orientation around the entire circumference of the fluid distribution disc. The knives must be oriented in such a way that the correct side of the blade comes into contact with the ground so that the fluid is properly injected and the knife does not snap off when entering the ground. With the knives in this configuration, it is difficult to reach toward the back of the fluid distribution disc and install or replace a knife. Not only is it out of reach, but also the knives are sharp and could cause an injury. Additionally, it is important that when installing the knife and its corresponding lock nut, the installation tool should not cause the knife to rotate out of its proper orientation. A long installation tool that aids in threading the knife onto the fluid distribution disc and holds the knife in place while tightening its corresponding lock nut would provide an easy and safe way to install or change a knife without causing injury, and while still allowing the knife to be securely fastened to the fluid distribution disc in the proper orientation.

Currently, there are tools that allow a user to extend his or her reach when inserting a part on a machine. But each of these tools suffers from several disadvantages. First, the tools do not allow a part to be properly oriented on a machine. Second, the tools do not allow a lock nut to be independently tightened on the part with the same tool.

Presently, there is no installation tool that allows a part to be properly oriented on a machine and allows a lock nut to be independently tightened on the part with the same tool. For the foregoing reasons, there is a need for a tool that would allow a person to use an installation tool that properly orients a part on a machine and independently tightens a lock nut.

SUMMARY OF THE INVENTION

The present invention is directed to a machine that satisfies the needs of providing a tool that allows a user to install a specific threaded part in an assembly.

A tool for installing a threaded part in an assembly of the present invention comprises an outer tube, an inner tube, a spring guide, a spring, and a handle. The outer tube further comprises an outer cog, a socket end with a socket plate, and a user end with a pair of apertures. The inner tube further comprises a guide plate and an inner cog. The spring guide further comprises a plurality of inline holes and a shaft. The inner tube and the spring guide are coupled together to create an inner mechanism such that the inner mechanism fits inside the outer tube. The spring is positioned inside the shaft of the spring guide so that when the spring is in a neutral state the outer cog and the inner cog are engaged and the inner mechanism and the outer tube rotate together. When the spring is in a compressed state, the outer cog and the inner cog are disengaged and the inner mechanism and the outer tube rotate independently. The threaded part is placed in the guide plate on the inner tube and is threaded onto the assembly when the inner cog and the outer cog are engaged and the spring is in a neutral state. The socket plate engages a nut that is on the threaded part and tightens it on the threaded part when the inner cog and the outer cog are disengaged and the spring is compressed. The handle is inserted through the pair of apertures on the outer tube and the inline holes on the user side of the spring guide so that the threaded part is held in place by the inner mechanism when the inner cog and the outer cog are disengaged.

It is an object of the present invention to reduce time while improving the quality of the work done installing a threaded part onto an assembly.

It is a further object of the present invention to reduce the cost, both of installing and support, of a special threaded part needing proper rotational position, especially if there is a high quantity of threaded parts to install.

It is a further object of the present invention to provide a tool that can be used where there is limited room for installing threaded parts.

It is a further object of the present invention to increase safety where surroundings may be sharp, confining, or hazardous due to other elements such as gases or radiation.

The novel features that are considered characteristic of the invention are set forth with particularity in the appended claims. The invention itself, however, both as to its structure and its operation together with the additional object and advantages thereof will best be understood from the following description of the preferred embodiment of the tool for installing threaded knives with lock nuts when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C §112, paragraph 6 to define the invention. To the contrary, if the provisions of 35 U.S.C §112, paragraph 6 are sought to be invoked to define the invention(s), the claims will specifically state the phrases "means for" or "step for" and a function, without also reciting in such phrases any structure, material, or act in support of the function.

Moreover, even if the provisions of 35 U.S.C §112, paragraph 6 are invoked to define the inventions, it is intended that the inventions not be limited only to the specific structure, material or acts that are described in the preferred embodiments, but in addition, include any and all structures, materials or acts that perform the claimed function, along with any and all known or later developed equivalent structures, materials, or acts for performing the claimed function.

DESCRIPTION OF PREFERRED EMBODIMENTS

Figure 1:
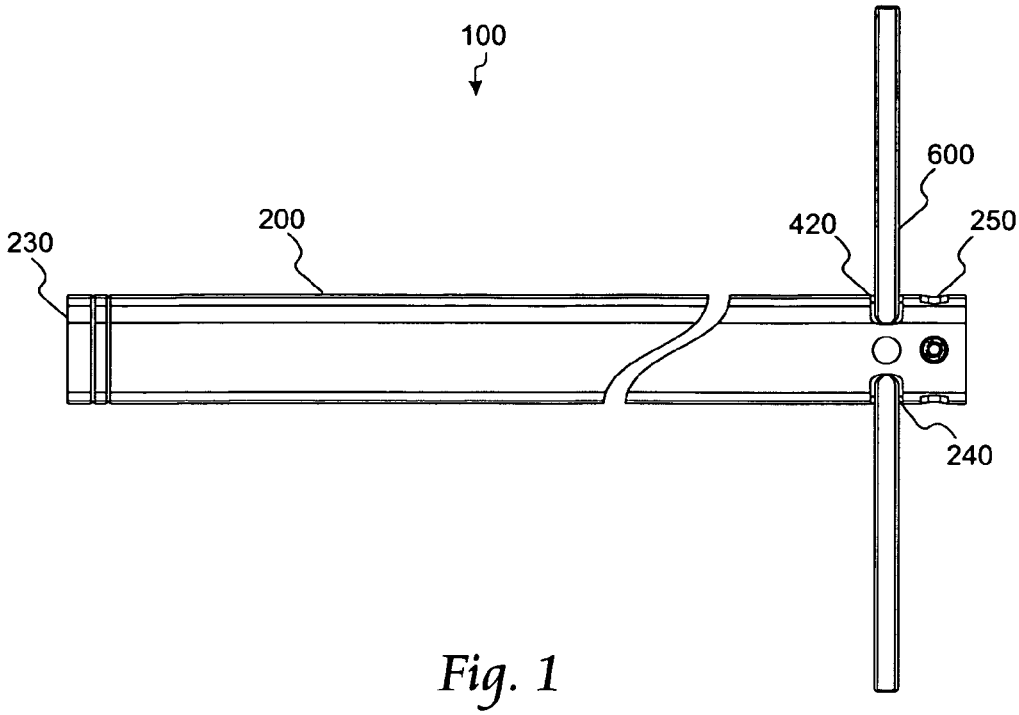
FIG. 1 shows a perspective view of the preferred embodiment of the installation tool.
Figure 2:
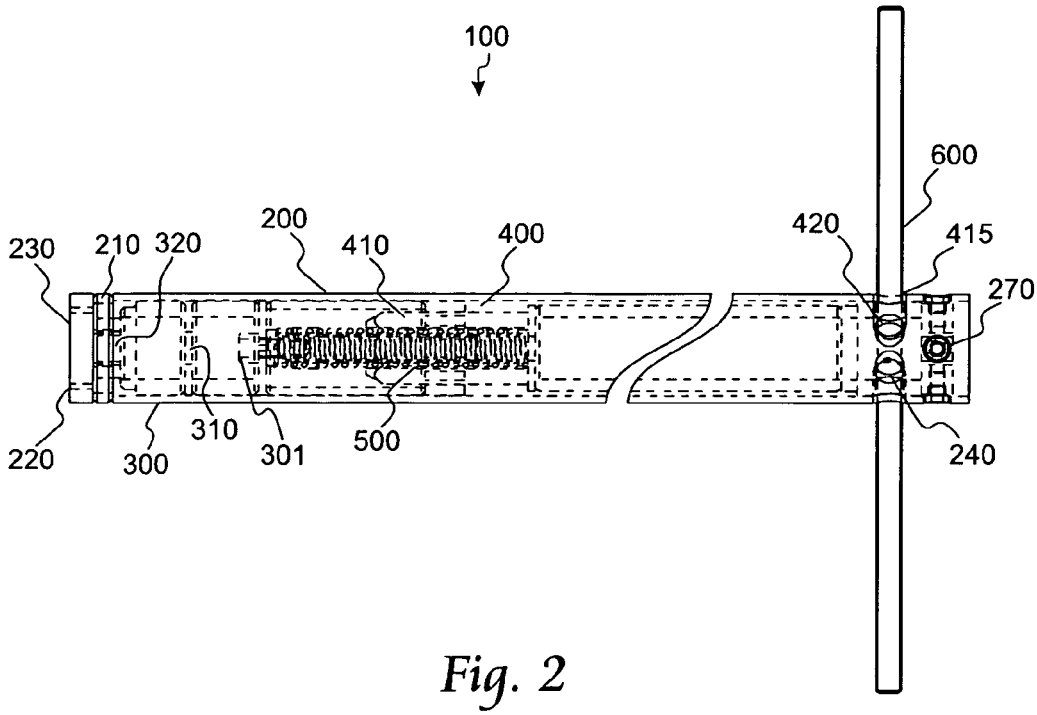
FIG. 2 shows a cross section of the installation tool in FIG. 1.

FIGS. 1 and 2 depict a preferred embodiment of an installation tool 100 for use with threaded parts on a machine or other assembly. The installation tool 100 comprises an outer tube 200, an inner tube 300, a spring guide 400, a spring 500, and a handle 600.

Figure 3:
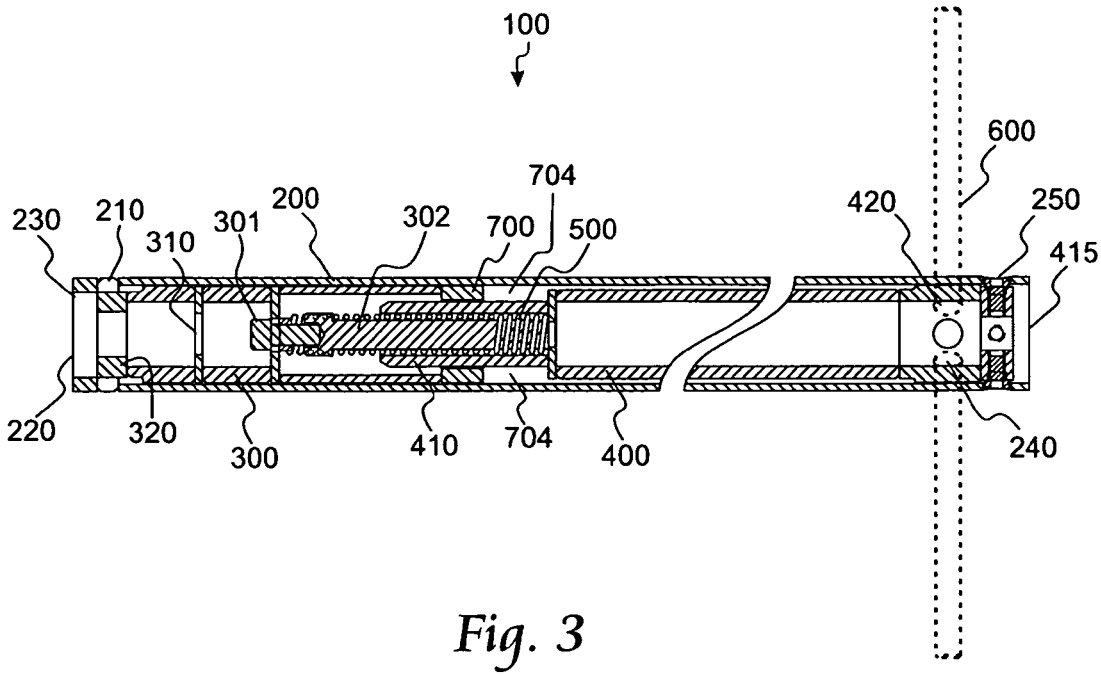
FIG. 3 shows a cross section of the installation tool in FIG. 1.
Figure 3A:
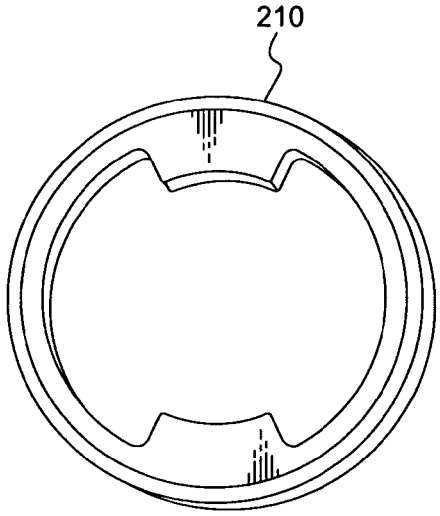
FIG. 3A shows a top view of an outer cog.
Figure 3B:
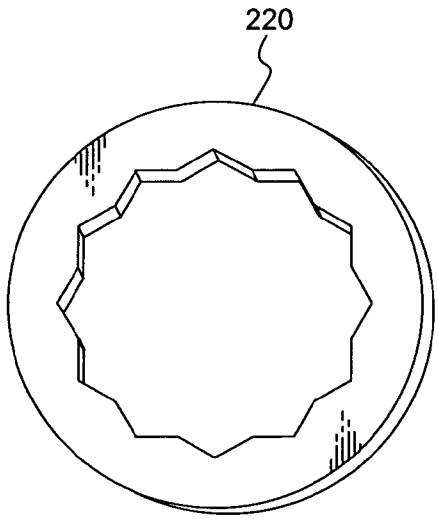
FIG. 3B shows a top view of a socket plate.
Figure 4:
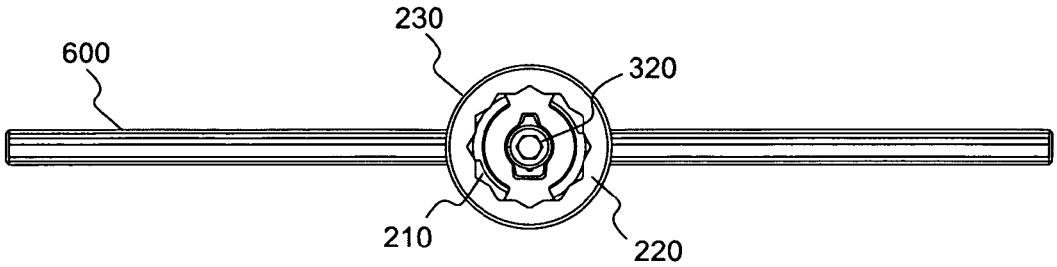
FIG. 4 shows a bottom view of the installation tool in FIG. 1.

Preferably, as shown in FIGS. 3–3B, the outer tube 200 includes an outer cog 210 and a socket plate 220 on its socket end 230 and a pair of elongated apertures 240 on its user end 250. The outer cog 210 and the socket plate 220 are coupled together, preferably by welding, as shown in FIG. 2. In the preferred embodiment, the socket plate 220 is a 12-point socket plate 220 that is capable of receiving a hex nut, and the outer cog 210 is round and fits between the socket plate 220 and the inner cog 320 as shown in FIG. 4. The pair of elongated apertures 240 that is located at the user end 250 of the outer tube 200 allows a user to insert the handle 600 through the outer tube 200 and an inner mechanism 700 as illustrated in FIGS. 1, 2, and 3.

Figure 5:
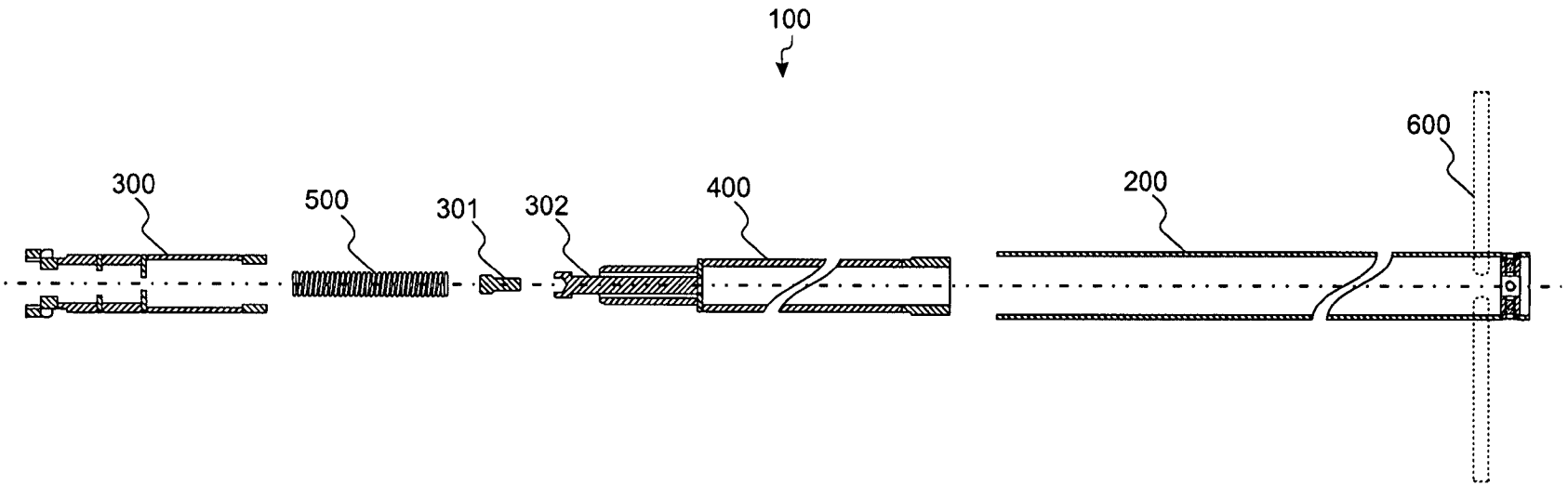
FIG. 5 shows an expanded view of the installation tool in FIG. 1.

Inside the outer tube 200 are the inner tube 300 and the spring guide 400 as depicted in FIG. 3. The inner tube 300 and the spring guide 400 are coupled together and form an inner mechanism 700. As illustrated in FIGS. 3 and 5, in the preferred embodiment, there is a first screw 301 and a second screw 302 that connect the inner tube 300 and the spring guide 400 together. The first screw 301 connects to the inner tube 300 and to the second screw 302. The second screw 302 is preferably a socket head cap screw which allows the first screw 301 to fit into its head. The spring 500 is positioned around the second screw 302 and inside the shaft 410 of the spring guide 400.

Figure 3C:
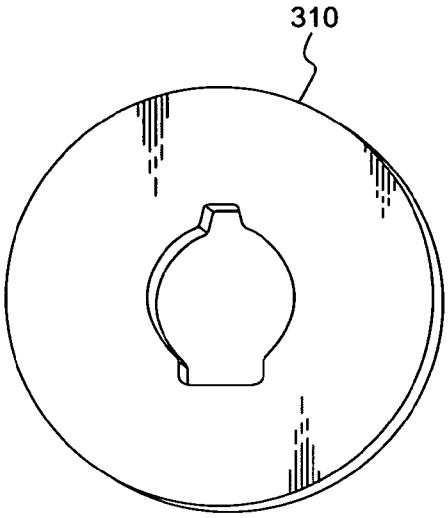
FIG. 3C shows a top view of a guide plate.
Figure 3D:
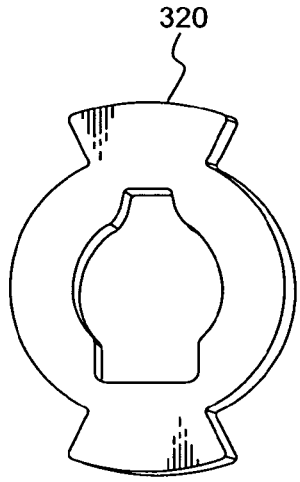
FIG. 3D shows a top view of an inner cog.

In the preferred embodiment, the inner tube 300 further includes a guide plate 310 and an inner cog 320 as shown in FIGS. 3, 3C, and 3D. The guide plate 310 is shaped so that the threaded part will fit into the guide plate 310 in only one orientation. In the preferred embodiment, the threaded part is a knife 800 for use in a prior art injection machine 900 as shown in FIGS. 8–8E and 9–9B, and the guide plate 310 is a knife guide plate 310 as shown FIG. 3C. Preferably, the prior art injection machine 900 is the machine described in U.S. Pat. No. 6,848,376, incorporated by reference herein. The knives 800 fit onto the fluid distribution disc 910 on the injection machine 900 and are used to inject specialized fluid and fertilizer into the soil as shown in FIGS. 9A and 9B.

Figure 9:
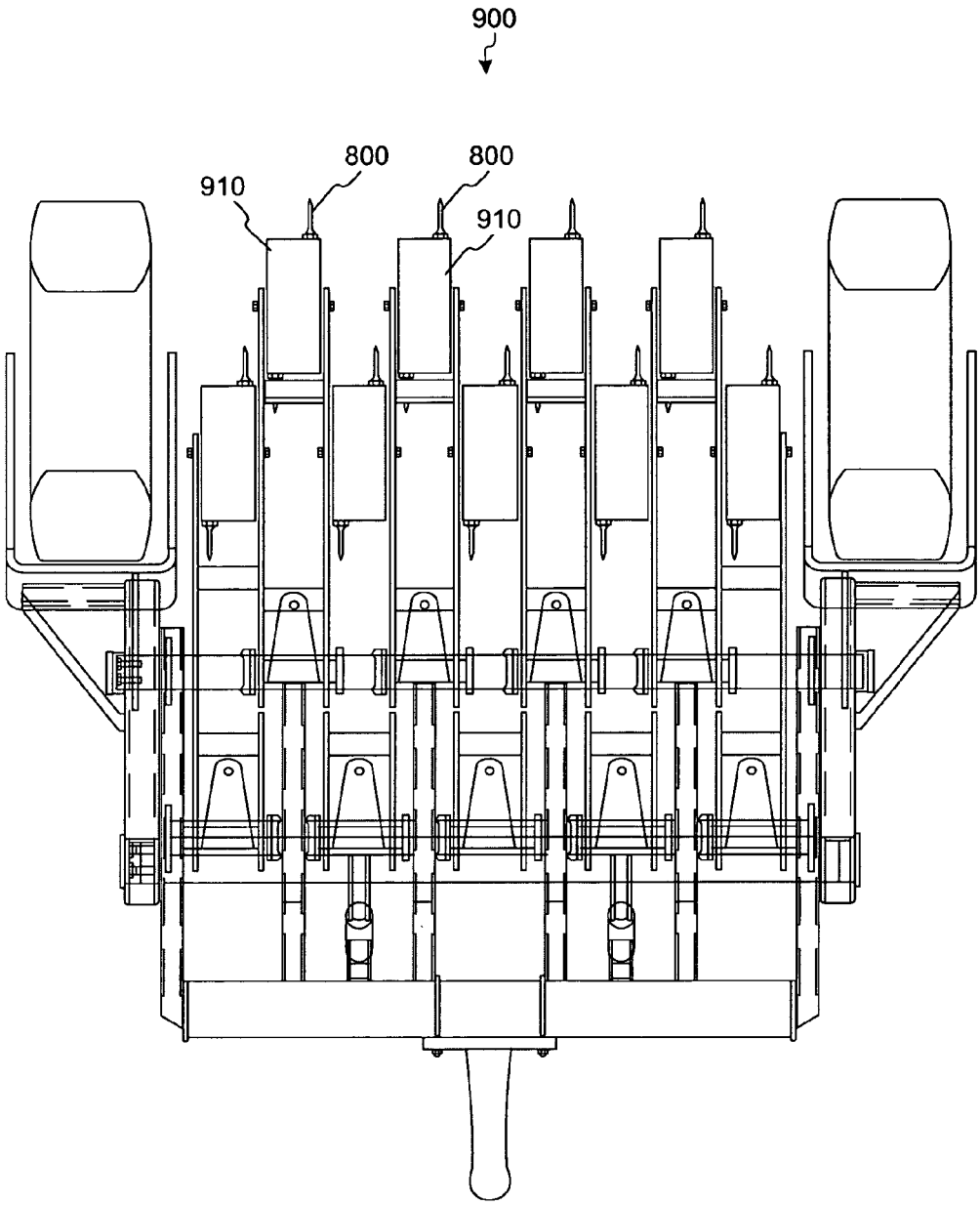
Fig. 9 (prior art)
FIG. 9 shows a prior art injection machine.
Figure 9A:
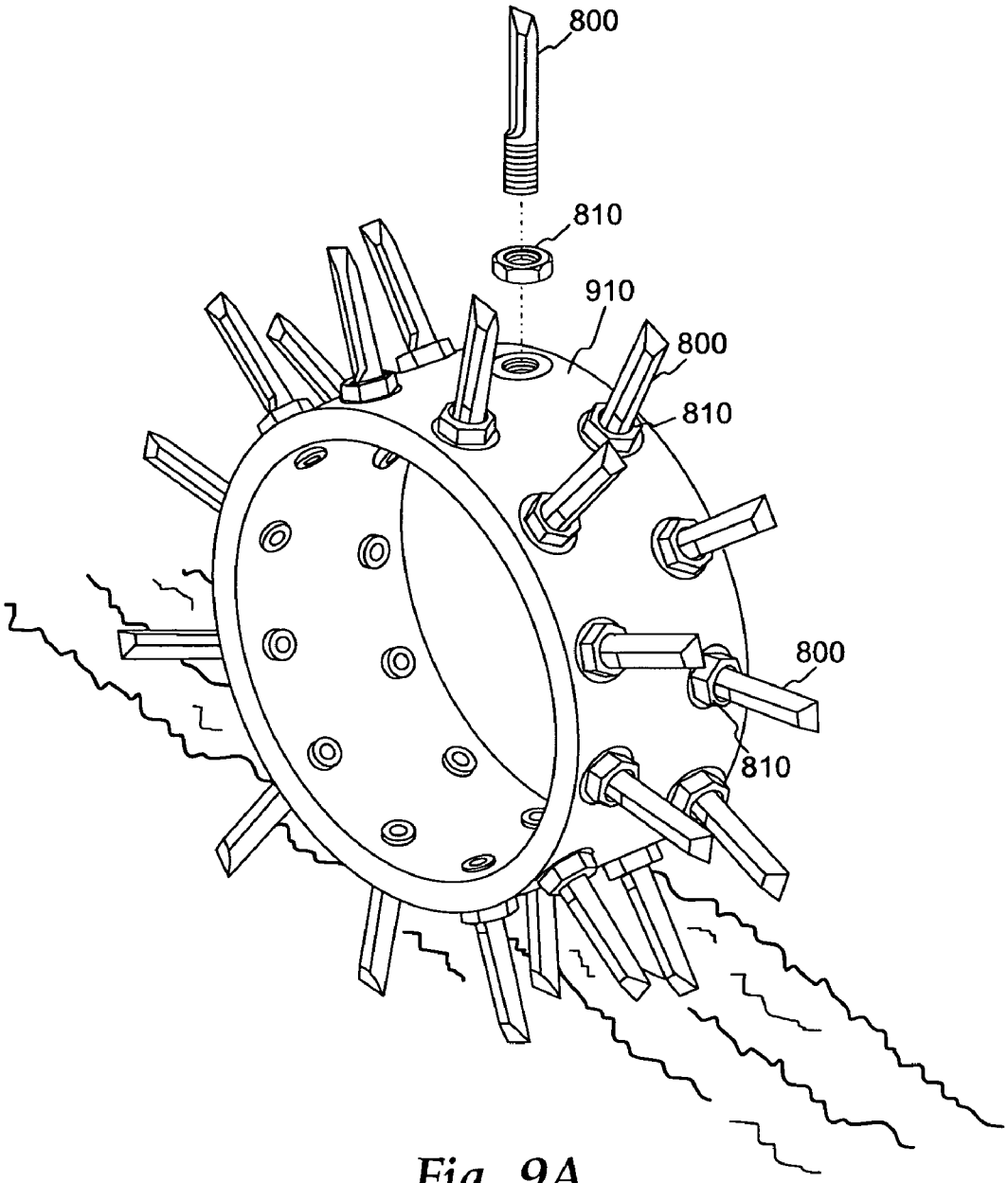
Fig. 9A (prior art)
FIG. 9A shows a fluid distribution disc with knives on the prior art injection machine shown in FIG. 9 as it is in contact with the ground.
Figure 9B:
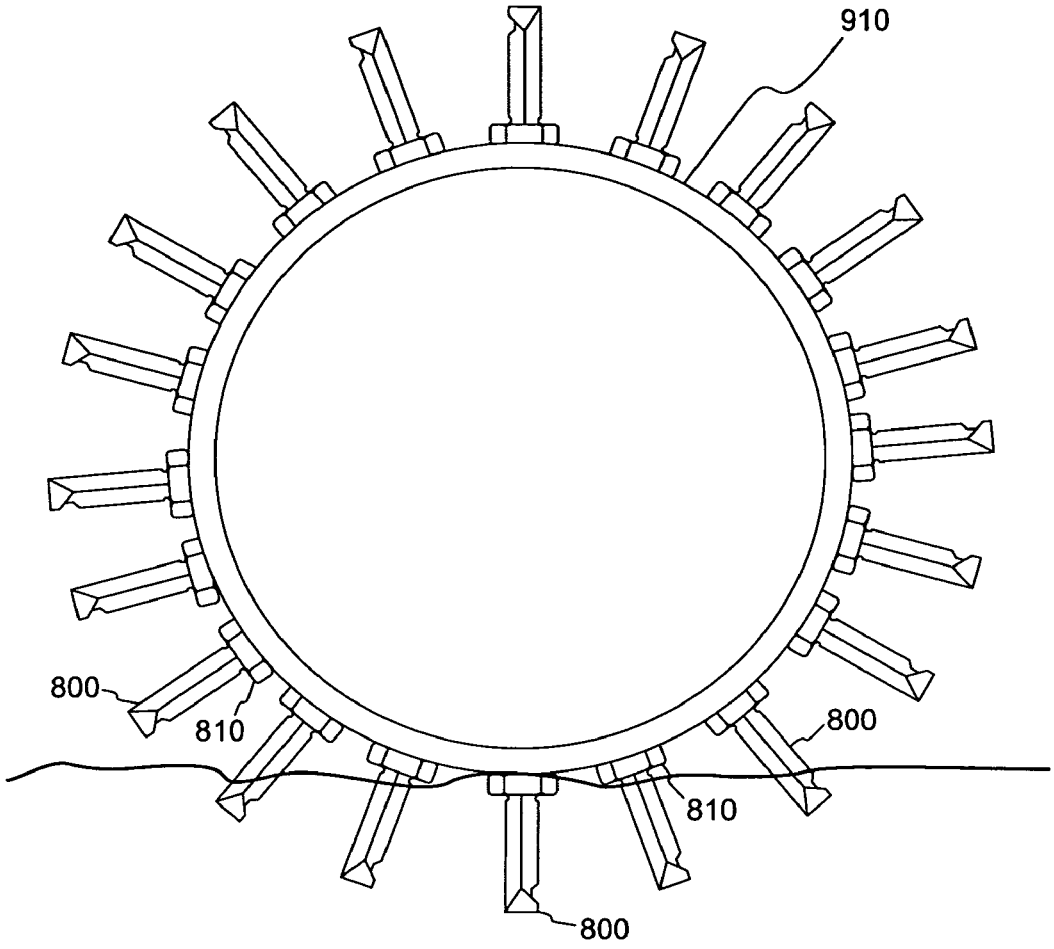
Fig. 9B (prior art)
FIG. 9B shows a side view of the fluid distribution disc with the prior art knives properly oriented to penetrate the ground and inject fluid into the soil.

As seen in FIGS. 9–9B, the prior art injection machine 900 comprises at least one fluid distribution disc 910 with multiple rows of knives 800. It is difficult and dangerous to reach into the fluid distribution disc 910 to install the knives 800 during the building or servicing in the field of the injection machine 900 because of the arrangement of the fluid distribution discs 910. Specifically, as seen in FIGS. 9–9B, some of the knives 800 are located away from where a user can comfortably reach. The knives 800 fully encircle the fluid distribution disc 910 making it difficult to install the knives 800. Additionally, it is important that each knife 800 be properly oriented on the injection machine, as seen in FIG. 9B, so that the knife 800 properly injects fertilizer into the soil and does not snap off when contacting the ground. As seen in FIG. 9B, the knife 800 must be oriented so that the sharp top edge 820 of the knife 800 contacts the ground first and penetrates the soil. The square side 830 of the knife 800 then goes into the soil and releases fertilizer. The knife guide plate 310 ensures proper orientation onto the machine by holding the knife 800 in only one position in the installation tool 100.

The spring guide 400 includes inline holes 420 on a user end 415 of the inner mechanism 700 as illustrated in FIGS. 1, 2, and 3. Preferably, there are six (6) inline holes 420. The inline holes 420 line up with the pair of elongated apertures 240 on the outer tube 200. The inline holes 420 and elongated apertures 240 are sized so that with the handle 600 is placed through the inline holes 420, the inner mechanism 700 can be turned 60° or held in place. The handle 600 is placed through one of the elongated apertures 240 and the inline holes 420 and emerges from the outer tube 200 through the second elongated aperture 240, as shown in FIGS. 1, 2, and 3, to hold the inner mechanism 700, and therefore the knife guide plate 310 and knife 800, in place when the lock nut 810 is being tightened on the knife 800. This ensures that the knife 800 will be properly oriented on the injection machine 900.

Figure 6:
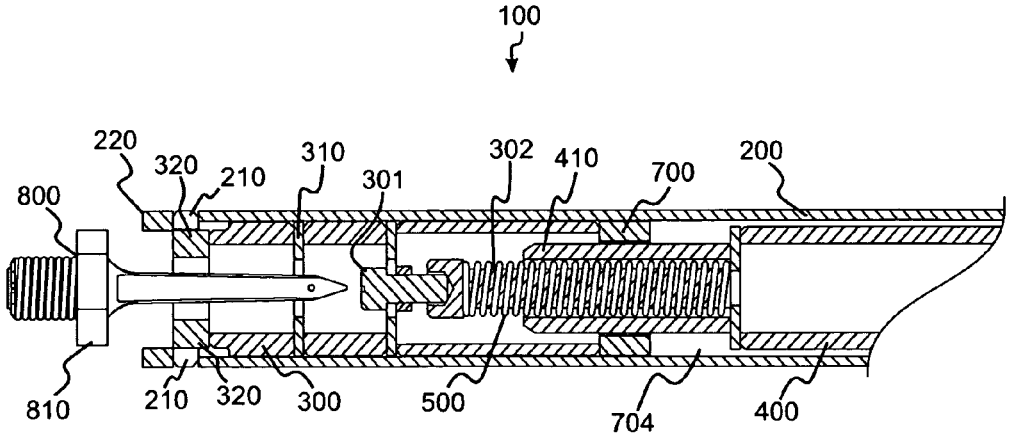
FIG. 6 shows a cross section of the installation tool in FIG. 1 with the spring in a neutral state and a prior art knife inserted into the tool.
Figure 7:
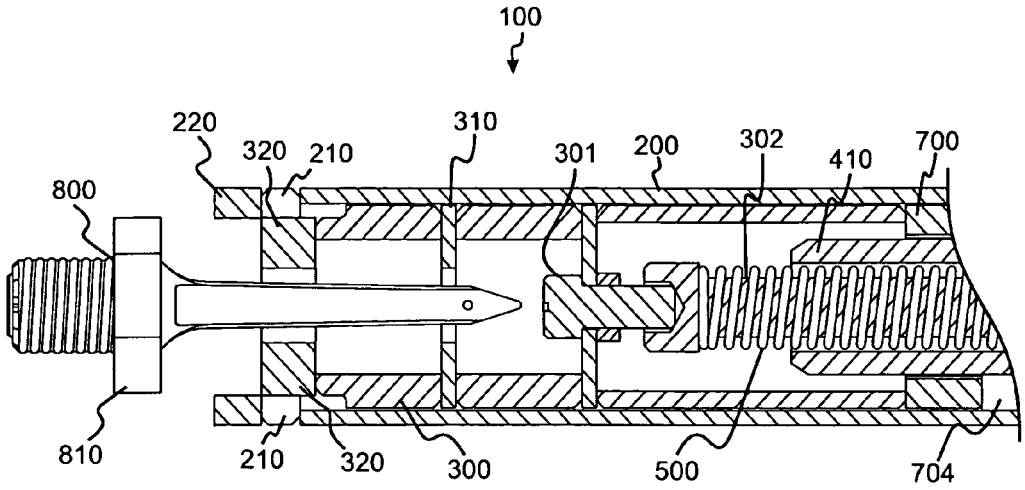
FIG. 7 shows a close up view of FIG. 6 with the spring in a neutral state.

The inner cog 320 is shaped to interconnect with the outer cog 210 as seen in FIGS. 3A and 3D and includes a cut out in the center that matches the shape of the threaded part and the guide plate 310. The cut out allows the threaded part, here the knife 800, to be inserted and held in place. When the spring 500 is in a neutral state, the outer cog 210 and inner cog 320 are interconnected and engaged as seen in FIGS. 6 and 7. While the inner cog 320 and outer cog 210 are engaged, the outer tube 200 and inner mechanism 700 rotate together and allow the user to tighten the threaded part, here the knife 800, onto the injection machine 900 where it belongs. The tip of the knife 800 is inserted into the inner tube 300 through the socket plate 220, outer cog 210, and inner cog 320. The knife 800 inserts into the knife guide plate 310 and rests against the head of the screw 301. The knife guide plate 310 is configured so that the sharp top edge 820 of the knife 800 and the square side 830 of the knife 800 will only fit one way. The installation tool 100 is then rotated, and the knife 800 is installed on the fluid distribution disc 910 of the injection machine 900. The installation tool 100 can either be powered by the user or an outside source by attaching the outer tube 200 to a power source via a square socket 270 on the user side 250 of the installation tool 100.

In the preferred embodiment of the installation tool, a marking 205 is added on the outside of the outer tube 200 so that the user can easily know the direction of the knife 800 on the fluid distribution disc 910 without having to remove the installation tool 100. Specifically, the marking 205 provides a way for the user to know when to stop rotating the knife 800 without removing the installation tool 100. When the user inserts the knife 800 into the installation tool 100, he or she can memorize the position of the marling 205 relative to the orientation of the knife 800. As the outer tube 200 is turned and the knife 800 threaded onto the fluid distribution disc 910, the user can watch the marking 205 on the outer tube 200 and know when the knife 800 is properly oriented. It is preferred that the marking be on the outer tube 200 in a position that corresponds with the location where the inner cog 320 and outer cog 210 fit together.

Figure 6A:
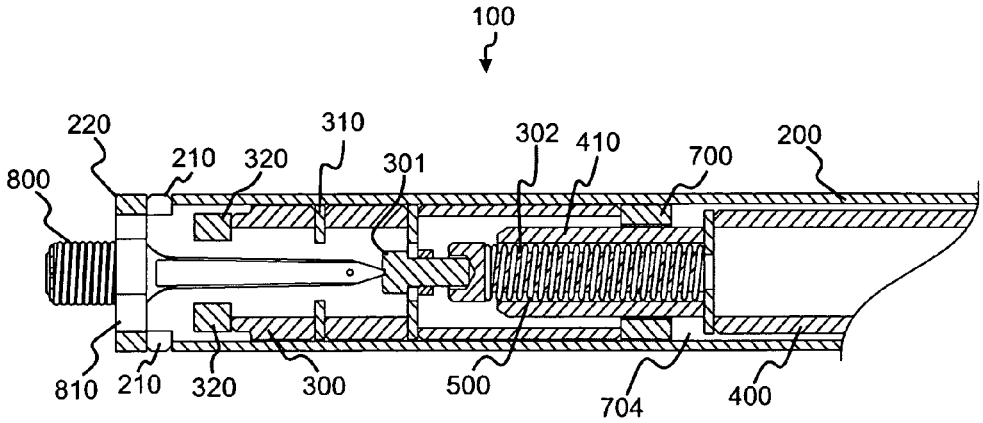
FIG. 6A shows a cross section of the installation tool of FIG. 1 with the spring in a compressed state and the prior art knife pressing on a screw to compress the spring.
Figure 7A:
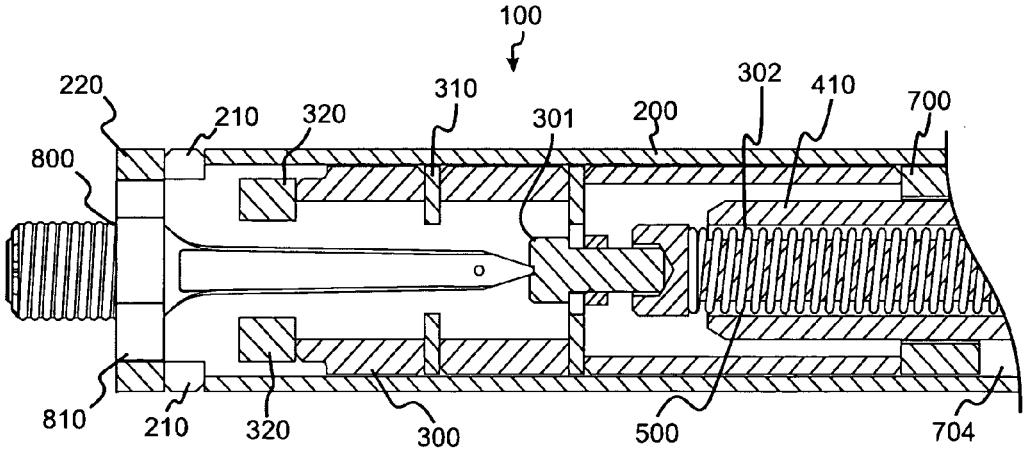
FIG. 7A shows a close up view of FIG. 6A with the spring in a compressed state.
Figure 8:
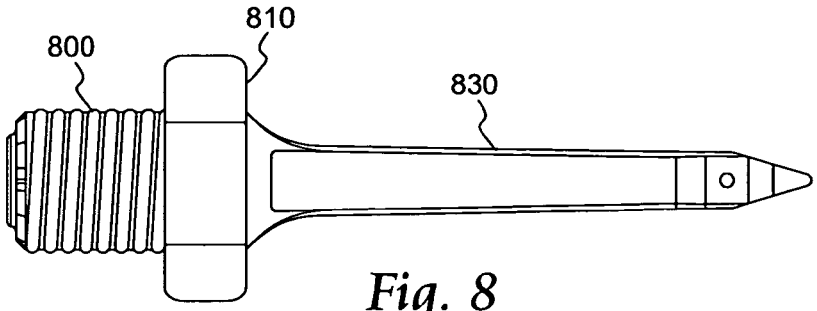
Fig. 8 (prior art)
FIG. 8 shows a side view of the bottom edge of a prior art knife with a lock nut attached.
Figure 8A:
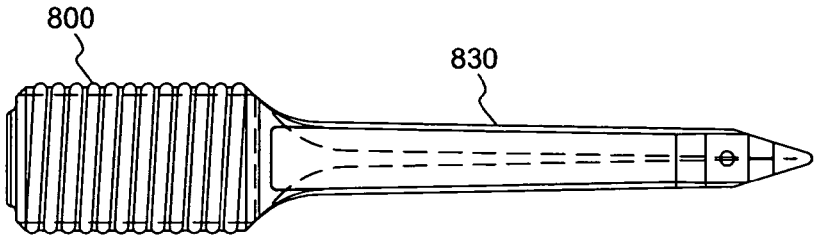
Fig. 8A (prior art)
FIG. 8A shows a side view of the prior art knife shown in FIG. 8 with hidden lines.
Figure 8B:
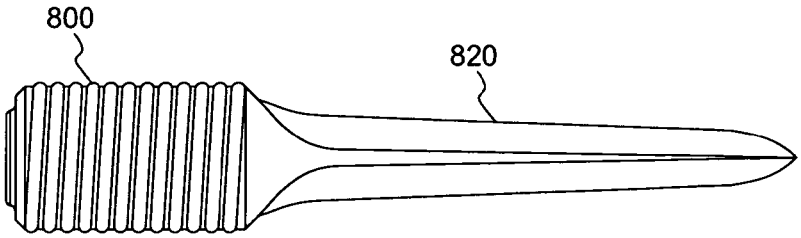
Fig. 8B (prior art)
FIG. 8B shows a side view of the top edge of the prior art knife shown in FIG. 8.
Figure 8C:
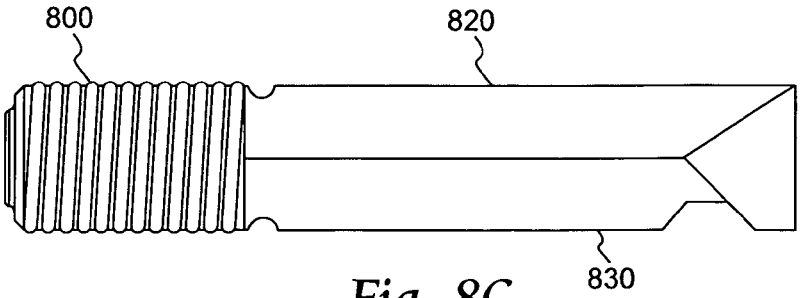
Fig. 8C (prior art)
FIG. 8C shows a side view of the side edge of the prior art knife shown in FIG. 8.
Figure 8D:
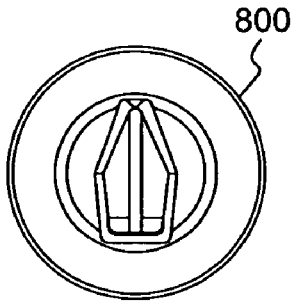
Fig. 8D (prior art)
FIG. 8D shows an end view of the prior art knife shown in FIG. 8.
Figure 8E:
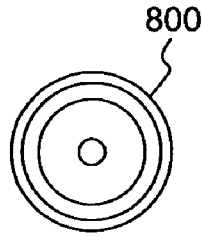
Fig. 8E (prior art)
FIG. 8E shows a top view of the prior art knife shown in FIG. 8.
Figure 8F:
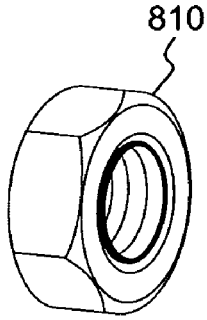
Fig. 8F (prior art)
FIG. 8F shows a lock nut that fits onto the prior art knife shown in FIG. 8.
Figure 8G:
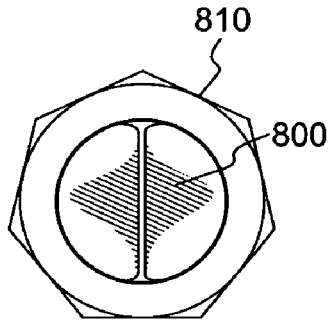
Fig. 8G (prior art)
FIG. 8G shows a top view of the prior art knife in FIG. 8 with the lock nut attached.

Once the knife 800 is in place on the injection machine 900, the lock nut 810 must be tightened onto the knife 800. When tightening the lock nut 810 onto the knife 800, it is important that the knife 800 does not rotate out of position on the fluid distribution disc 910 so that the knife 800 does not snap off when contacting the ground and properly injects the fertilizer into the soil. To tighten the lock nut 810 without affecting the orientation of the knife 800, the user pushes down on the user end 250 of the outer tube 200 so that the socket plate 220 engages the lock nut 810 as seen in FIGS. 6A and 7A. Pushing down on the user end 250 of the outer tube 200 compresses the spring 500 and causes the inner cog 320 and outer cog 210 to disengage as illustrated in FIGS. 6A and 7A.

When the inner cog 320 and outer cog 210 disengage, the socket plate 220 attaches to the lock nut 810, preferably a hex nut, on the knife 800. At the same time, the inner tube 300 slides down around the spring guide 400 and the space 704 is closed. The force of the knife 800 pressing on the screw 301 compresses the spring 500. Because the inner tube 300 is attached to the spring 500, the entire piece moves. The outer tube 200, with the socket plate 220 and outer cog 210, then rotates independently from the inner mechanism 700 to tighten the lock nut 810 onto the knife 800. When the lock nut 810 is being tightened onto the knife 800 with the outer tube 200, the knife 800 and inner mechanism 700 are held in place with the handle 600 inserted through the pair of elongated apertures 240 and the inline holes 240. The knife 800 is then properly oriented on the injection machine 900 and the lock nut 810 is secured into place using only the single installation tool 100.

More specifically, the handle 600 is inserted into one of the elongated apertures 240 on the outer tube 200 and then through a pair of inline holes 420 and then emerges from the other elongated aperture 240. When the handle 600 is in this position, the inner mechanism 700 is held in place and the outer tube 200 is able to make a partial turn. In other words, the outer tube 200 can move 60° relative to the inner mechanism 700. At this point, the handle 600 is removed and reinserted through one of the elongated apertures 240 on the outer tube 200 and the next available pair of inline holes 420 and emerges from the other elongated aperture 420. The outer tube 200 is then turned another 60°. This process is repeated until the lock nut 810 is tightened onto the knife 800. The rotating and reinsertion of the handle 600 allows the user to use one installation tool 100 to install and properly orient the knife 800 and tighten the lock nut 810 into place.

The preferred embodiment of the invention is described in the Description of Preferred Embodiments. While these descriptions directly describe the one embodiment, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. A tool for installing a threaded part in an assembly, said tool comprising:

A. an outer tube, said outer tube further comprising:
   1. an outer cog;
   2. a socket end, said socket end further comprising a socket plate; and
   3. a user end, said user end further comprising a pair of apertures;

B. an inner tube, said inner tube further comprising:
   1. a guide plate; and
   2. an inner cog;

C. a spring guide, said spring guide further comprising:
   1. a user side, said user side further comprising a plurality of inline holes; and
   2. a shaft;

D. a spring;

E. a handle;

F. said inner tube and said spring guide are coupled together to form an inner mechanism such that said inner mechanism fits inside said outer tube;

G. said spring is positioned inside said shaft of said spring guide such that when said spring is in a neutral state said outer cog and said inner cog are engaged and said inner mechanism and said outer tube rotate together, and when said spring is in a compressed state said outer cog and said inner cog are disengaged and said inner mechanism and said outer tube rotate independently, H. said threaded part is placed through said inner cog and in said guide plate in said inner tube and is threaded onto said assembly when said inner cog and said outer cog are engaged and said outer tube and said inner mechanism rotate together;

I. said socket plate engages a nut on said threaded part such that said nut is tightened on said threaded part when said inner cog and said outer cog are disengaged and said outer tube and said inner mechanism rotate independently; and J. said handle is inserted through said pair of apertures on said outer tube and said inline holes on said user side of said spring guide such that said threaded part is held in place by said inner mechanism when said inner cog and said outer cog are disengaged.

2. The tool in claim 1 wherein said threaded part is a knife for use on a fluid injection machine.

3. The tool in claim 2 wherein said guide plate is a knife guide plate.

4. The tool in claim 2 wherein said inner cog has an opening that accommodates said knife for use on an injection machine.

5. The tool in claim 1 wherein said socket plate is a 12 point socket plate.

6. The tool in claim 1 wherein said tool further comprises a square socket on the outer tube that can be connected to a power source.

7. The tool in claim 1 wherein said outer tube further comprises a marking such that said marking allows a user to properly orient said threaded part on said assembly.

* * * * *